US005593353A

United States Patent [19]

Kramer

[11] Patent Number: 5,593,353

[45] Date of Patent: Jan. 14, 1997

[54] PUTTING STROKE TRAINING APPARATUS

[76] Inventor: Jeffrey Kramer, 3545 Lake Ave., Wilmette, Ill. 60091

[21] Appl. No.: 504,185

[22] Filed: Jul. 19, 1995

[51] Int. Cl.[6] ..... A63B 69/36

[52] U.S. Cl. ..... 473/205; 473/213

[58] Field of Search ..... 273/67 B; 473/205, 473/213, 276, 212

[56] References Cited

U.S. PATENT DOCUMENTS

| | | | |
|---|---|---|---|
| 819,250 | 5/1906 | Paget | 273/67 B |
| 1,469,315 | 8/1921 | Hansard . | |
| 3,065,472 | 5/1961 | Linnell . | |
| 3,423,095 | 10/1965 | Cox . | |
| 3,467,379 | 5/1966 | Kistner . | |
| 3,700,245 | 10/1972 | Nannini | 473/213 |
| 3,855,633 | 12/1974 | Rhee | 273/67 B X |
| 4,138,108 | 2/1979 | Robinson | 273/189 A X |
| 4,241,922 | 12/1980 | Elliott | 273/189 A |
| 5,088,122 | 2/1992 | O'Toole . | |
| 5,170,508 | 12/1992 | Kawada . | |

*Primary Examiner*—George J. Marlo
*Attorney, Agent, or Firm*—Brinks Hofer Gilson & Lione

[57] ABSTRACT

The present invention relates to a putting stroke training apparatus comprising a arcuate, elongated rigid member adapted to fit over the front of the right forearm, wrist and hand of a right-handed golfer. The rigid member has a first strap on one end and an elastic band with a second strap on the opposite end to secure the forearm, wrist and fingers against the rigid member. The apparatus prevents the muscles in the wrist and fingers from flexing and contracting during the swing, thereby training the muscles and muscle memory for an improved putting stroke.

3 Claims, 2 Drawing Sheets

PUTTING STROKE TRAINING APPARATUS

BACKGROUND OF THE INVENTION

The present invention relates to an apparatus to be worn by a golfer. More particularly, this invention relates to an apparatus to help golfers develop a proper putting stroke by restricting the flexing and contracting action of the right wrist and the third, fourth and fifth fingers of the right hand (for a right-handed golfer) during the stroke.

It is generally agreed by many golfing experts that the right wrist (for a right-handed golfer) should break forward minimally, if at all, when putting the ball to achieve maximum power transfer and control. If the wrist breaks forward more than slightly, the effect is to cause the wrist and fingers three, four and five of the right hand to contract, thereby causing the forearm and hand to turn inward or pronate. The effect on the stroke is that the putter turns to the left and downward, and does not squarely meet the ball as is proper. If there is severe pronation, the club head may undesirably hit the putting surface prior to striking the ball. At minimum, though, any amount of pronation will have an adverse effect on the path and speed of the ball.

In the prior art, attempts have been made to improve a golfer's swing by limiting the backward break or backward bend of the golfer's hands. U.S. Pat. No. 3,423,095 issued to Cox (the "Cox patent") discloses a device that prevents the backward breaking of the left wrist (for a right-handed golfer) during a swing. Cox teaches that doing so lessens the chance that a driven golf ball will hook or slice rather than take flight in a direct line.

U.S. Pat. No. 5,170,508 issued to Kawada (the "Kawada patent") discloses a golf glove to prevent the left hand and thumb (of a right-handed golfer) from bending backward during a swing.

However, neither the Cox patent nor the Kawada patent addresses the contraction of the wrist and fingers during putting, or the problems associated with the forward flexing of the wrist and fingers.

Thus, there has existed a long-standing need among golfers for a training apparatus that would prevent golfers from flexing or collapsing their wrist forward when putting, thereby reducing poor strokes and wayward putts.

SUMMARY OF THE INVENTION

Briefly stated, the putting stroke training apparatus that forms the basis of the present invention comprises an arcuate elongated rigid member adapted to fit over the front of the hand and the front forearm (for right-handed golfers). The rigid member has an adjustable strap affixed on one end to keep the golfer's hand and fingers in a fixed, extended position. An elastic band is attached to the opposite end of the rigid member. The elastic band has an adjustable strap affixed to it to secure the elastic band around the wrist and forearm. A golf glove may be optionally affixed to the rigid member and to the elastic band, such that the elastic band substantially encompasses at least the wrist portion of the glove when the adjustable strap on the elastic band is fastened.

When the adjustable strap on the elastic band is fastened, the forearm and wrist are pressed against the rigid member, restricting the ability of the wrist and the fingers to flex forward. Consequently, repetitive usage of this invention in practicing and simulating putting strokes will train the involved muscles to naturally resist the forward flexing motion even when the golfer is not wearing the device. Other objects and advantages will become apparent from the following description and accompanying drawings.

DESCRIPTION OF THE PREFERRED EMBODIMENTS

Figure 1:
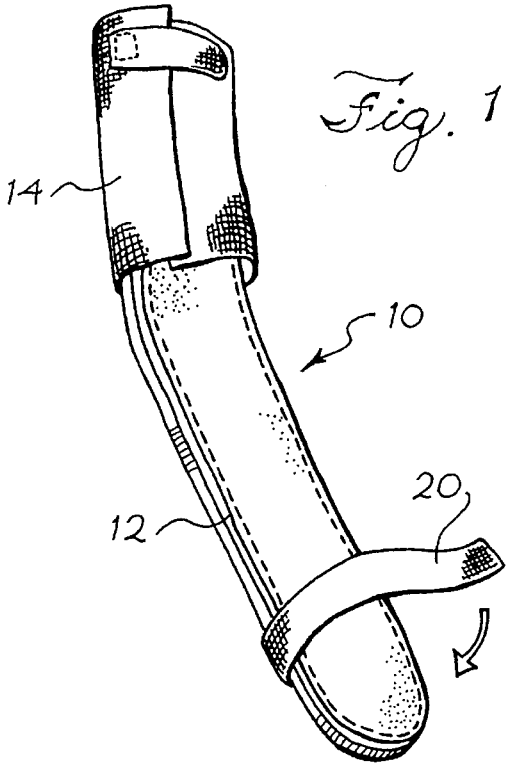
FIG. 1 is a perspective view of the subject putting stroke training apparatus.

As can be seen by reference to the drawings, and in particular to FIG. 1, the putting stroke training apparatus that forms the basis of the present invention is designated generally by the reference numeral 10. Though specifically shown for a right-handed golfer, a similar apparatus can be devised for a golfer who putts left-handed as well. The putting stroke training apparatus 10 comprises an arcuate elongated rigid member 12 adapted to fit over the front of the hand and the front forearm. The rigid member 12 may have a padded surface of some type covering at least the areas where a golfer's hand and forearm will contact.

Figures 3, 5:
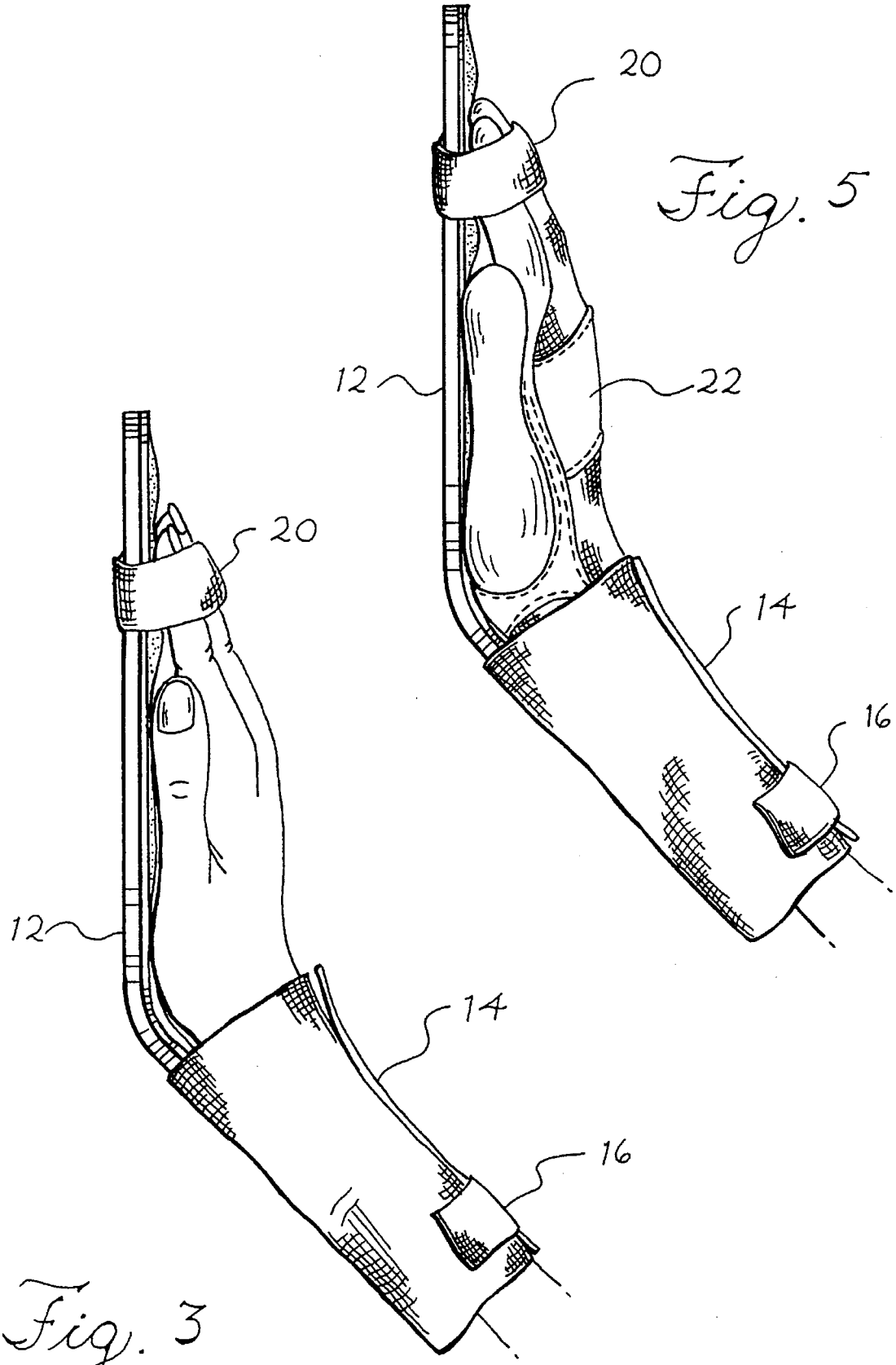
FIG. 3 is a side elevational view of the putting stroke training apparatus secured over a right forearm, wrist and hand.
FIG. 5 is a side elevational view of the embodiment of FIG. 4 with the putting stroke training apparatus secured over a right forearm, hand and wrist.

As can be ascertained from FIG. 3, the rigid member 12 extends from the wearer's forearm toward the tips of the fingers. An elastic band 14 is affixed to the rigid member 12 nearest to the end of the rigid member 12 that rests on the forearm.

Figure 2:
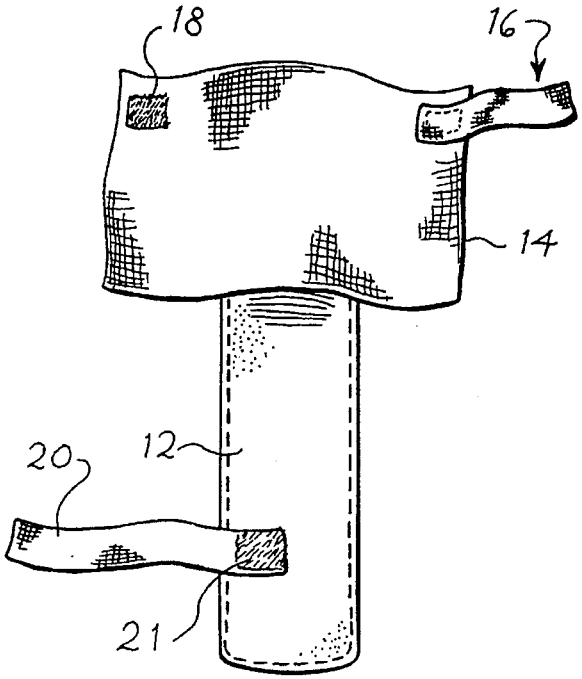
FIG. 2 is a bottom plan view of the putting stroke training apparatus.

In FIG. 2, it can be seen that the elastic band 14 is sewn onto the rigid member 12. Of course, other methods of affixing the elastic band 14 to the rigid member 12, such as snaps, buttons, or a fuzz latch mechanism, are within the scope of the present invention. The elastic band 14 is positioned such that when worn it will encompass a substantial portion of the wrist and lower forearm. A first strap 16 allows the elastic band 14 to close firmly around the wrist and forearm. In the preferred embodiment, the strap 16 is a Velcro fuzz latch strap. A coarse surface swatch 18 of material adapted to receive the strap 16 is sewn onto the elastic band 14 opposite the strap 16. The strap 16 can be tightened or loosened by adjusting the position of the strap 16 on the coarse surface swatch 18. Of course, other types of adjustable straps, or fasteners, such as buckles, snaps or buttons fall within the scope of the present invention. At the opposite end, the rigid member 12 has a strap 20 sewn on the bottom, such that the strap 20 can extend orthogonally around the longitudinal plane of the rigid member 12. In the preferred embodiment, the strap 20 is a one-piece Velcro fuzz latch strap, where a small portion of the back of the strap 20 is a coarse swatch 21 adapted to receive the Velcro material on the strap 20.

Figure 4:
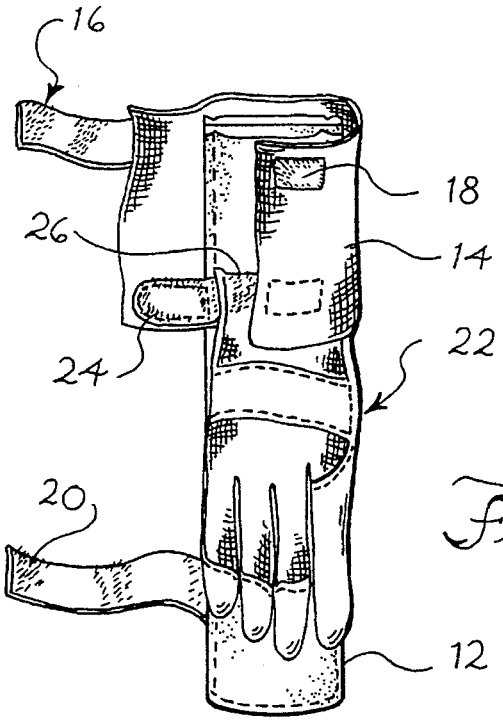
FIG. 4 is a top plan view of an alternative embodiment of the putting stroke training apparatus with an attached conventional glove.

FIG. 4 is an alternative embodiment of the present invention where a conventional golf glove 22 is attached to the rigid member 12 and to the elastic band 14. The glove's strap 24 is sewn to the inner surface of the elastic band 14. Many conventional golf gloves have Velcro material straps that, when incorporated in the alternative embodiment of FIG. 4, can be used to press the forearm and wrist more firmly against the rigid member 12. The Velcro material strap typically consists of a strap 24 and a coarse swatch 26 of material adapted to accept the strap 24. A portion of the glove 22 in close proximity to the coarse swatch 26 is also preferably sewn to the inner surface of the elastic band 14.

FIG. 5 is an illustration of the alternative embodiment of FIG. 4 where the golfer's hand is inserted into the glove 22 and strapped under the elastic band 14 and the strap 20.

In both the preferred and alternative embodiments, the golfer's fingers are inserted under the strap 20 and secured by wrapping the strap 20 orthogonally around the longitudinal plane of the rigid member 12.

In use, the right hand of a player is inserted onto the rigid member 12 such that the crease of the wrist rests comfortably near the curved region of the rigid member 12. The elastic band 14 is wrapped around the wrist and forearm area and secured firmly by positioning the strap 16 onto the coarse swatch 18. The golfer's fingers will rest under the strap 20 against the rigid member 12.

In the alternative embodiment utilizing the golf glove 22, the player's right hand is inserted into the glove 22 and the strap 24 on the glove 22 is positioned on the coarse swatch 26, thereby increasing the pressure between the rigid member 12 and the golfer's hand, wrist and forearm. Wearing the putting stroke training apparatus 10, the golfer must then make repetitive practice or simulated strokes, thereby training the muscles and muscle memory of the wrist and fingers not to flex or contract during the swing.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A putting stroke training apparatus comprising:

an arcuate elongated rigid member having a first planar surface and a second planar surface opposite said first planar surface, said first and second planar surfaces being adapted to fit over the front of the hand and front forearm respectively, including the wrist;

a first strap affixed to said first planar surface for adjustably holding at least the third, fourth and fifth fingers of said hand in place against said first planar surface;

an elastic band affixed on said second planar surface positioned thereon such that it encompasses a substantial portion of said wrist; and a second strap affixed to said elastic band for adjustably closing the elastic band and holding said wrist in place against said second planar surface.

2. The putting stroke training apparatus of claim 1 wherein said first strap includes a fuzzy material on one side of said first strap and a swatch of coarse material on the other side of said first strap, said coarse swatch being adapted to receive said fuzzy material.

3. The putting stroke training apparatus of claim 1 wherein said second strap includes a fuzzy material affixed to one end of said elastic strap and a swatch of coarse material on the opposite end of said elastic strap, said coarse swatch being adapted to receive said fuzzy material.

* * * * *